United States Patent [19]

Crum et al.

[11] 4,026,440

[45] May 31, 1977

[54] ADHESIVE GUN

[75] Inventors: Gerald W. Crum, Elyria; Eric T. Nord, Oberlin; Alan B. Reighard, Bay Village; Simon Z. Tamny, Lorain, all of Ohio

[73] Assignee: Nordson Corporation, Amherst, Ohio

[22] Filed: Nov. 24, 1975

[21] Appl. No.: 634,360

Related U.S. Application Data

[63] Continuation of Ser. No. 500,751, Aug. 26, 1974, abandoned, which is a continuation of Ser. No. 307,020, Nov. 16, 1972, abandoned.

[52] U.S. Cl. ..... 222/146 R

[51] Int. Cl.[2] ..... B67D 5/62

[58] Field of Search .... 222/146 R, 146 H, 146 HE, 222/146 C, 334, 386; 219/230, 421; 228/52, 53; 401/1, 2; 425/378 R, 379 R

[56] References Cited

UNITED STATES PATENTS

| | | | |
|---|---|---|---|
| 2,233,558 | 3/1941 | Shaw | 219/421 |
| 2,682,386 | 6/1954 | Lindsay | 251/335 |
| 3,377,012 | 4/1968 | Cushman | 222/146 HE |
| 3,543,968 | 12/1970 | Reighard et al. | 222/146 R |
| 3,550,815 | 12/1970 | Salonen | 222/146 |
| 3,587,930 | 6/1971 | Schultz | 222/146 HE |

*Primary Examiner*—Stanley H. Tollberg
*Assistant Examiner*—H. Grant Skaggs
*Attorney, Agent, or Firm*—Wood, Herron & Evans

[57] ABSTRACT

A thermoplastic material dispensing apparatus adapted to translate feedstock from a solid state to a molten state by a novel heater block structure, and to discharge the molten feedstock through a novel discharge valve in response to operation of a novel trigger device. A novel annular cooling chamber is established about the dispenser's barrel to maintain a solid/melt interface inside the barrel adjacent to the heater block structure, that zone being air cooled by inlet air taken from a single inlet air line. The inlet air from the single line also drives the dispenser's ram through use of a novel pneumatic motor/spool valve mechanism. The spool valve is manually stroked forward to extend the dispenser's ram for extruding the feedstock, and is manually stroked rearward to retract the ram for recharging. Other features include a novel visual telltale that disappears when recharging of the dispenser is desirable, and a novel safety interlock that prevents exposure of the charging port for recharging unless the dispenser's ram has been fully retracted and that insures retention of the ram in that fully retracted position while the charging port is so exposed.

30 Claims, 12 Drawing Figures

ADHESIVE GUN

This application is a continuation of application Ser. No. 500,751, filed Aug. 26, 1974, which application is in turn a continuation of application Ser. No. 307,020, filed Nov. 16, 1972, both now abandoned.

This invention relates to a hand-held, manually operated dispensing device adapted to translate a solid feedstock into a melt, and to discharge that molten feedstock when same is desired by an operator. More particularly, this invention relates to a hand-held dispenser device especially adapted for use with a hot melt adhesive.

In recent years, the use of thermoplastic materials as adhesives has become quite commonplace in many industries. Typical of such adhesives is the so-called "hot melt" adhesive. The hot melt adhesive is useful in that it provides a strong quick setting bond between workpieces. The quick setting characteristics derives from the fact that the adhesive melts or converts to the molten state at a high temperature, e.g., 305° F relative to ambient. Because of the large temperature gradient between ambient and the melt temperature of the hot melt adhesive, it quickly converts to a solid state upon exposure to the atmosphere, thereby providing the rapid bond characteristic. The quick setting or bonding characteristic of the hot melt adhesive has opened up multiple and diverse uses for that type adhesive. For example, it is widely used in the packaging industry for the erection and closure of paperboard cartons, corrugated cartons, and the like. Further, it is widely used in the furniture industry in connection with initial construction as well as repair. Further, it finds use in the clothing industry in, for example, the manufacture of raincoats, shoes and the like.

A number of hand gun type dispensing devices are known to the prior art for applying hot melt adhesive to a workpiece. Each such hand gun device is in the nature of an extruder in the sense that it translates solid feedstock into melt form, and then discharges that molten feedstock onto the workpiece as desired by an operator. Such a dispensing device is generally referred to as a gun because of its overall similarity in configuration and operation to a hand gun. That is, each such hand gun type dispensing device is generally provided with a pistol grip or handle portion, a generally barrel-shaped portion within which the feedstock is melted, and a trigger mechanism by means of which feedstock discharge from the barrel is controlled. More specifically, a typical hand gun type dispenser for hot melt adhesive includes a barrel, and a heater block located at the barrel's fore end. A ram located at the barrel's aft end forces solid feedstock through the barrel into proximity with the heater block where it is turned molten at a solid/melt interface. The molten adhesive is then directed from the heater mechanism to a discharge valve/nozzle, discharge of the molten adhesive being controlled by the gun's trigger mechanism.

However, there are a number of problem areas inherent in fabricating a practical and efficient hand gun type dispenser device in light of the hot melt material characteristics and the general abuse and wear to which guns of this type are put in an operating environment. These problems are basically associated with reliability of the device from an equipment performance standpoint under operational conditions.

One major problem area of the prior art devices concerns the heater block structure, and the need for efficient heat transfer from the heater block to the feedstock so as to transform the material from a solid to a molten state.

Current art principally uses three means of heating the thermoplastic: a barrel heater located circumferentially around the exterior of the barrel, a heated flat plate at the forward end of the barrel against which the adhesive is forced, an internally heated torpedo-shaped element located axially within the gun's barrel, the point or nose of the torpedo facing the gun's ram; or combinations thereof. In the case of the barrel heater, thermal energy is transferred radially into the circumference of the thermoplastic which then melts and is free to flow back along the circumference of the thermoplastic toward the ram, causing sealing and safety problems and tending to lock up the gun, preventing further advance of the ram and thermoplastic. The heated flat plate also suffers from melt flowback problems along the circumference of the thermoplastic and additionally offers a small heat transfer area to the thermoplastic requiring a high power density at the surface with attendant control and material degradation problems if a high melt rate is to be achieved. With an internally heated torpedo the feedstock first contacts the heater blocks's nose (which is in the nature of a point) as it is pressed into interengagement therewith by the gun's ram. If the heaters within the torpedo are operated at a sufficiently high power level to maintain the temperature of the nose above the melting or softening point of the feedstock, then the temperature of the lateral surfaces of the torpedo will be high enough to char or degrade the feedstock material. Conversely, if the heater power level is reduced to bring the lateral surface temperature down to a safe level, then the poor heat transfer geometry of the torpedo will allow the nose temperature of said torpedo to drop below the softening or melting temperature of the feedstock and thereby prevent further advance of the feedstock and ram.

The initial contact heat transfer problem multiplies the problem of controlling the solid/melt interface within the gun's barrel so as to prevent the molten material from moving rearwardly into the gun barrel's charging port area. If the solid/melt interface is not maintained closely adjacent the torpedo's nose, the gun's ram may well become hung up or stuck within the gun barrel so as to preclude further use of the gun prior to disassembling and cleaning.

Another major problem area of the prior art devices concerns the mechanics of operating the gun, and the disadvantages of those mechanics from an equipment maintenance standpoint. For example, most prior art trigger mechanisms (and, therefore, most prior art discharge valves) can be overloaded past the breaking point by an operator on restart if the thermoplastic remaining in the gun has not reached a molten state. Oftentimes, an operator tends to feel that any operational problem with a gun of this general type can be corrected simply by pulling or depressing the trigger as hard as is humanly possible, until the gun breaks.

A further problem in connection with the guns of this type arises in connection with retraction of the gun's ram after a feedstock charge has been fully expended, or after the ram becomes stuck intermediate in its stroke from fully charged to fully exhausted positions. Generally speaking, in most prior art devices the gun's ram is not positively driven in both the forward and reverse directions; most often the gun's ram is positively driven in the eject direction but is only spring loaded in the retract direction. If the gun's ram becomes bound within the barrel, it is often the case that the spring loading is not sufficient to overcome that binding. This means the gun must be disassembled for cleaning.

Further, none of the examples of current art use a melt pressurization system capable of generating large axial forces. Experiment has shown that large forces, translated into high fluid pressures in the range of 300 pounds per square inch at the solid/melt interface, are necessary to move the melted feedstock out of the solid/melt interface since a layer of fluid remaining at the solid/melt interface serves to insulate the solid from the melted, limiting the melt rate. Such high forces will, of course, further intensify the melt back or leakage problem. Lack of a means to generate these high pressures tends to limit current art devices to either low melt rates, or to materials which have low viscosity when melted.

Still a further major problem area of the prior art devices concerns safety hazards, and lack of operational indicators, from an operator's standpoint. Feed or charging ports found on guns of this type open directly into the gun's barrel and, thereby, directly expose an operator's fingers to the gun's ram. Of course, such provides a distinct safety problem to the operator unless there is some kind of an interlock between the barrel's charging port and the motor drive for the gun's ram. Further, guns of this type do not include a telltale device by which an operator can visually observe at a glance when the gun's barrel needs recharging with feedstock. Such, of course, is undesirable from an operator's standpoint in that he must be constantly checking the feedstock level by opening and closing the barrel's charging port, thereby exposing his fingers, etc. to the potential safety hazards.

Generally speaking, it has been a primary objective of this invention to provide an improved hand gun type thermoplastic dispensing device that is particularly adapted for use with a hot melt adhesive.

Another objective of this invention has been to provide an improved heater block structure for use in thermoplastic material dispensing systems. In that regard, the heater block structure of this invention is in the nature of a tapered surface disposed axially within the gun's barrel, the tip of the tapered surface facing the gun's ram. An annular chamber is defined around the exterior of the gun's barrel just aft of the tip of the tapered surface, that chamber being ported to admit inlet air over a pressure drop so as to provide substantial cooling of the barrel at that location, thereby maintaining the solid/melt interface of feedstock adjacent to the heater block. The cooling air from within the annular chamber is exhausted forward around the barrel toward the heater block to secure additional cooling of the barrel.

It has been another objective of this invention to provide an improved trigger mechanism for a hand gun type device adapted to dispense a thermoplastic material, e.g., a hot melt adhesive. The improved trigger mechanism is structured to prevent operator breakage of the melt discharge valve no matter how hard the trigger is pulled. In accomplishing this objective, the discharge valve is adapted to linearly reciprocate in opening and closing a discharge orifice. The valve stem abuts against, but is not connected to, a spring loaded abutment that is reciprocable in a linear direction on the valve's linear reciprocation axis. The trigger is interconnected by a lost motion connection with the spring loaded abutment. When the trigger is pulled, the spring loaded abutment is retracted from interengagement with the valve, thereby allowing the valve to open for discharge of melt. The valve opens when the abutment is retracted only because of the melt's hydraulic pressure, i.e., it is not mechanically drawn open through a trigger connection. That is, the valve is configured so that hydraulic pressure from the melt causes it to open after the abutment has been withdrawn by the trigger against the bias of its spring loading. When the trigger is released, the spring loaded abutment biases the valve closed. Thus, the discharge valve cannot be overloaded (and, therefore, cannot be broken or otherwise adversely affected) by an operator through pulling hard on the trigger since pulling the trigger only releases an abutment from contact with the valve, the valve itself being opened by hydraulic pressure of the melt.

The lost motion characteristics of the trigger attachment to the spring loaded abutment prevents the valve from being held closed if the hydraulic pressure acting on the bellows is sufficient to overcome the bias of the spring. Thus, the valve is self-relieving and acts to protect the device from excessive internal pressures.

It has been still another objective of this invention to provide a novel control valve and pneumatic motor for operation of the ram in a hand gun type device adapted to dispense thermoplastic material, e.g., a hot melt adhesive. The control valve includes a spool valve axially aligned with the travel path of the gun's ram. The spool valve's porting is arranged so stroking the spool valve forward along the gun's housing by an operator allows the pneumatic motor to drive the ram forward for melt discharge, and stroking the spool valve rearward along the gun's housing allows the pneumatic motor to drive the ram rearward for recharging the feedstock. The spool valve is structured to admit pneumatic pressure onto both sides of the motor's piston head, and is also configured to allow exhausting of the air from both sides of the motor's piston head, depending on which side is under positive pressure, i.e., depending on whether the ram is being driven forward or rearward.

The pneumatic motor is designed to have a large ratio of piston to ram area allowing large axial forces, and therefore hydraulic pressures, to be generated with low air pressures.

It has been a further objective of this invention to provide safety structure in combination with the charging port for the extruder barrel in a hand gun type device adapted to extrude a thermoplastic material, e.g., a hot melt adhesive. That safety structure prevents recharging of the barrel unless the gun's ram is restrained in its fully retracted position. In one embodiment in which the gun is adapted to use granular feedstock, the hopper's lid is pivotally mounted relative to the gun's housing. The lid carries an extension which is movable into and out of the gun's barrel, i.e., into and out of the ram's path when the ram is fully retracted, to function as a safety stop on the ram. Since the lid's extension can move into the gun's barrel only when the ram is retracted, the hopper's lid can only be opened at that time. When the gun's ram is fully or partially extended, the hopper's lid cannot be opened because the lid's extension interengages the ram as attempt is made to move it into the barrel.

It is still a further objective of this invention to provide indicator means for a hand gun type device adapted to extrude a thermoplastic material, e.g., a hot melt adhesive, that visually indicates at a glance when recharging of the gun's barrel with additional feedstock is desirable. Toward this end, a telltale rod is aligned axially with a piston that powers the gun's ram, the telltale rod having an end that protrudes through the gun's housing when the gun's barrel is fully charged so as to visually indicate that status to the operator. The telltale rod slides axially relative to the piston, and is adapted to be picked up by the piston when the gun's ram approaches the fully extended position. Therefore, as the ram is extended (due to discharge of molten feedstock from the gun), the telltale rod is withdrawn into the interior of the gun. When the telltale rod fully disappears into the gun, such indicates recharging of the gun's barrel with additional feedstock is desirable.

Other objectives and advantages of this invention will be more apparent from the following detailed description taken in conjunction with the drawings in which.

GENERAL STRUCTURE AND OPERATION

The general structure of a hand gun type device adapted to dispense a thermoplastic material, e.g., a hot melt adhesive, in accord with the principles of this invention, is illustrated in the Figures.

Figure 1:
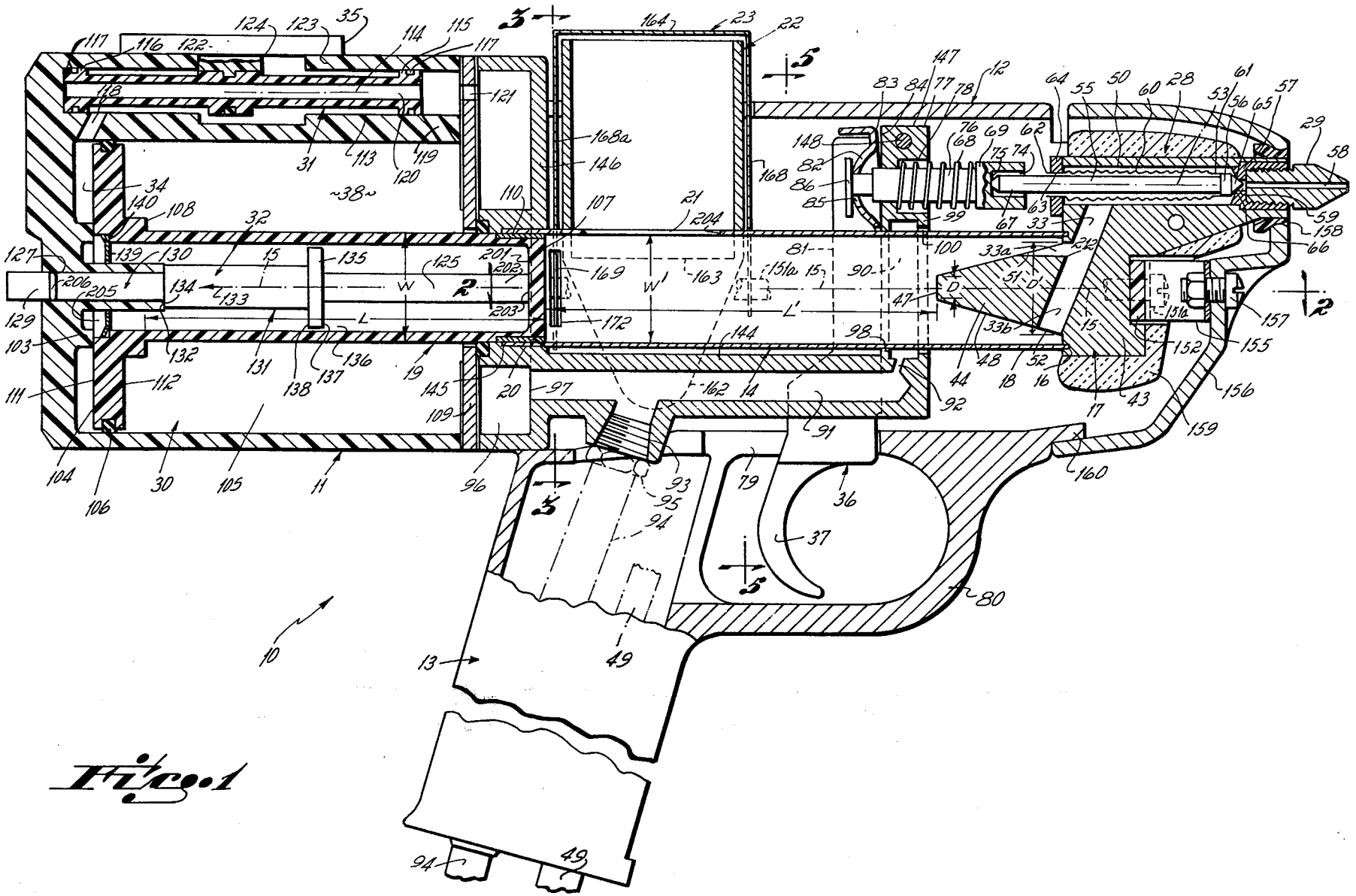
FIG. 1 is a cross sectional view taken axially of a hand gun adapted to extrude a thermoplastic material (e.g., a hot melt adhesive) structured in accord with the principles of this invention.

As shown in FIG. 1, the hand gun 10 includes a housing 11 having a generally barrel-shaped portion 12, and a pistol grip type handle portion 13 depending from the underneath side thereof. A cylindrical barrel 14 is located inside the gun's housing 11, the barrel's axis 15 being substantially parallel to the axis of the housing's barrel portion 12. The barrel 14 is seated, as at 16, in a heater block structure 17 at the fore end 18, and receives an axially movable ram 19 at the aft end 20. The ram 19 is driven fore and aft, i.e., is extended and retracted in a positive manner, by a pneumatic motor 30 that is controlled through use of a spool valve 31. A telltale rod 32, cooperatively interconnected with the ram 19 through the motor's piston head 104, indicates when recharging of the barrel 14 with additional feedstock is permitted.

The barrel 14 is charged with feedstock (of either powder, granules, or slug characteristics) through charging port 21 located topside of the barrel just forward of the ram 19 when the ram is fully retracted as shown in FIG. 1. When powder or granular feedstock 24 is used, a hopper 22 with safety lid 23 is mounted to cooperate with the charging port 21. When slug feedstock 25 is used, either a safety cover 26 is mounted to cooperate with the charging port 21 when the gun 10 is adapted to receive only one slug at a time (see FIGS. 9 and 10), or a slug turret 27 is mounted to cooperate with the charging port 21 when the gun is adapted to carry replacement slugs, too (see FIGS. 11 and 12).

A discharge valve 28 is located at the fore end 18 of the barrel 14, the discharge valve controlling discharge of molten feedstock through nozzle 29. Molten feedstock is transferred under hydraulic pressure from the barrel 14 to the discharge valve 28 through bores 33 in the heater block 17. The discharge valve 28 is actuable by an operator through use of a trigger assembly 36.

Figure 6:
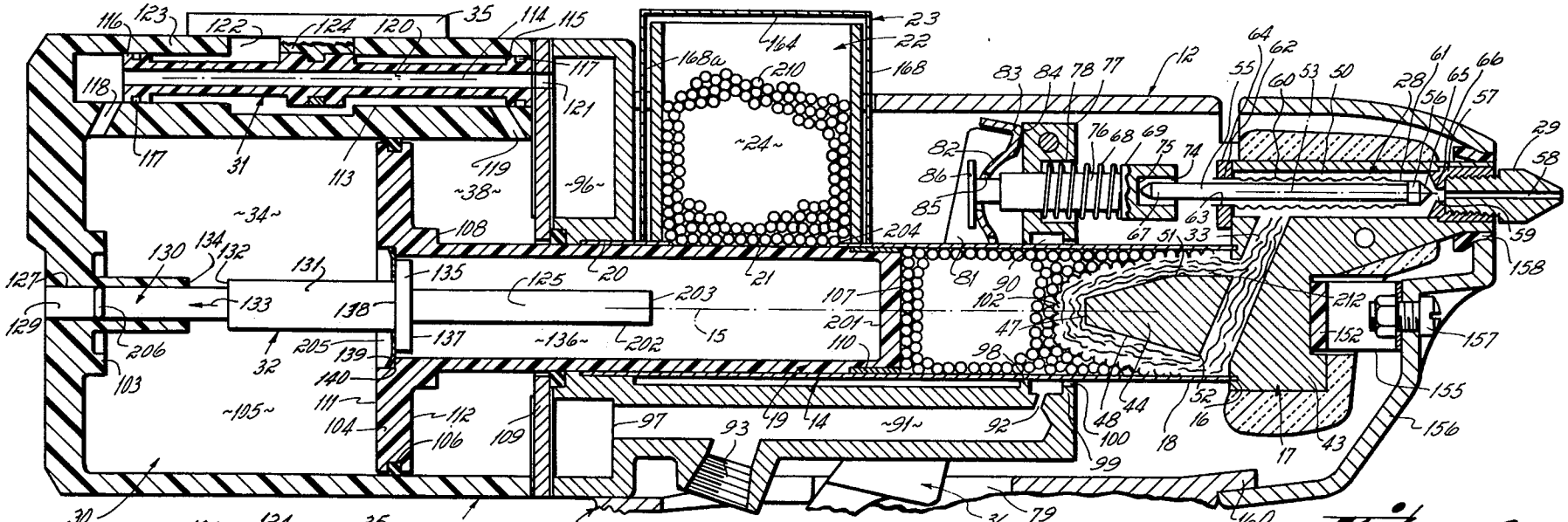
FIG. 6 is a partially broken away cross sectional view similar to FIG. 1 but showing the gun's ram in an intermediate extended attitude.

In use, the barrel 14 is first charged with feedstock while the ram 19 is fully retracted, see FIG. 1. Such charging can be accomplished only when ram 19 is fully retracted because of safety structure 23, 26 or 27 (depending on whether powder, granular or slug feedstock is used) associated with the barrel's charging port 21. Heat is introduced into the heater block 17 by energizing a switch (not shown), and high pressure air is introduced into first air chamber 34 by stroking handle 35 on spool valve 31 (and, hence, the spool valve itself) forward toward the gun's nozzle 29 (see FIG. 6). Such forces the feedstock against the heater block 17 where it is melted, and forces the feedstock through bores 33 into discharge valve 28. When desired by the operator, discharge valve 28 is opened by pulling on trigger 37, thereby discharging the desired quantum of melt through nozzle 29. When recharging of the barrel 14 is desired, high pressure air is transferred into second air chamber 38 by stroking handle 35 on spool valve 31 rearward toward the tail end of the gun's housing 11. Such returns the ram 19 to the charging position shown in FIG. 1 from a discharge position such as shown in FIG. 6.

GENERAL DESIGN OF HEATER STRUCTURE

With reference to FIGS. 1, 2, 6 and 7 of the drawings, it should be noted that the specific geometric design of the projection 44 of the heater block 17 is illustrated as a truncated right circular cone. However, the special physical characteristics inherent in this design can be met by several topologically similar geometries, such as:

a. The heater block 17 should have a heated base 43; the projection 44 is not internally heated but provides a heat transfer path from the heater base 43 through the projection 44 into the surrounding medium to be heated.

b. The truncated projection 44 has a continuous but not necessarily linear or axi-symmetric taper from its base to the opposite end thereof, e.g.; cone, pyramid, paraboloid, both regular and irregular, and annular or hollow centered version thereof.

c. The projection 44 should have a geometry which tends to physically force the material in a generally radially outward direction against the cooled barrel 14, thereby facilitating a seal and allowing the flow of molten material from its tip to the base end of the projection rather than impede or restrict it.

d. The barrel 14 is deliberately cooled to establish a large axial thermal gradient upstream of the heater block 17. This is in order to chill and solidify the melted material forced outward by the center projection, thus forming a seal. Further, the cooled barrel prevents premature melting of the solid material.

THERMAL CHARACTERISTICS OF HEATER

The tapered member, projection 44 of FIGS. 1, 2, 6 and 7, is designed to have certain specific heat transfer properties which must be present in combination in order to operate successfully as a thermoplastic melter at the design melt rate.

a. The total heated surface 47 and 48 exposed to the thermoplastic must be great enough to keep the power density below the point at which surface temperatures induce charring or other degradation of the feedstock when melting at the design rate.

b. The material selected for the projection 44 must have a sufficiently high thermal conductivity such that when transferring the required thermal energy from the heater block 17 to the tip surface 47, the temperature drop incurred does not allow the tip surface 47 temperature to go below the softening point of the feedstock.

c. The length of projection 44 between the heater block 17 and the tip 47 is coordinated with the base diameter D′ and tip diameter D to obtain the required surface area of paragraph a) above and within the allowable maximum temperature drop of paragraph b) above.

SPECIFIC STRUCTURE

Figure 2:
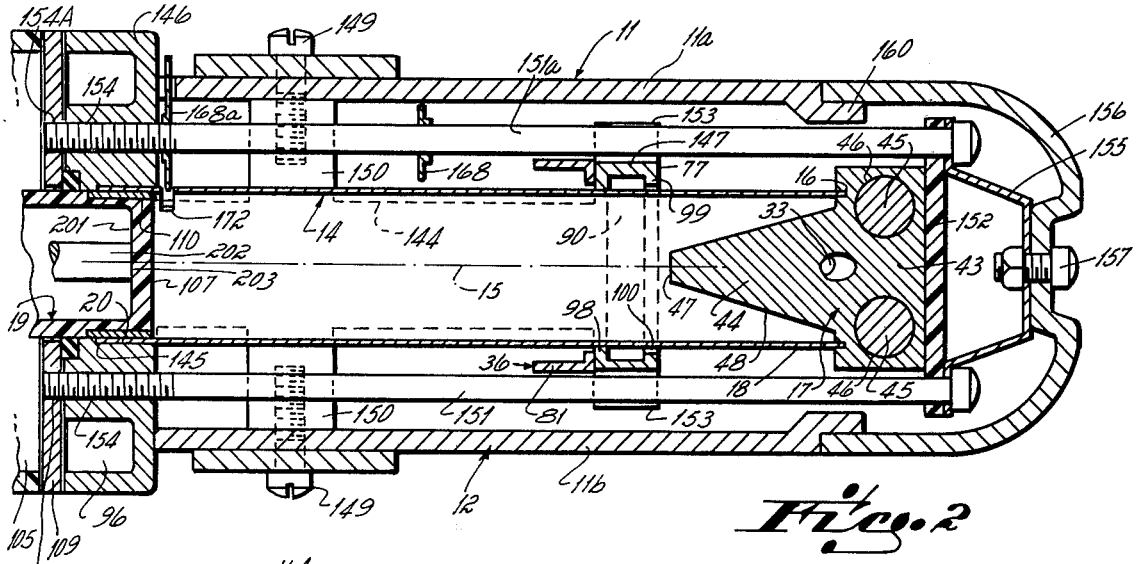
FIG. 2 is a cross sectional view taken along line 2—2 of FIG. 1.

In connection with the heating and cooling structure and discharge valve 28, note particularly FIGS. 1, 2, and 6. As shown therein, the heater structure is in the nature of a heater block 17 having a base 43 and a frusto-cone 44 integral with the base. The conical shaped portion of the heater block is foreshortened from its vanishing point to provide a blunt tip in the form of a flat face 47. Note that the flat face 47 of the frusto-cone 44 is oriented transverse to the barrel's axis 15, that the frusto-cone's axis is the same as the barrel's axis 15, that the minor face 47 of the cone faces the ram 19, and that the frusto-conical side 48 is substantially straight from the face 47 to the base 43. Instead of being straight sided 48, the sides of the frusto-cone may be slightly convex or slightly concave if desired. Preferably the major cone diameter D′ is substantially the same as the barrel's inside diameter.

A frusto-conical configuration is used for the heater block 17 because it has been found that same provides optimum heat transfer characteristics for melting a solid thermoplastic material such as a hot melt adhesive in a hand gun type dispensing device. It is desired from a heat transfer standpoint that the entire heater block 17, and especially the frusto-cone 44, be formed of copper because of its optimum properties in connection with heat transfer; however, aluminum or silver may be used too. At relatively high operational temperatures, it may be desirable to nickel-plate the copper's exposed faces because of copper's tendency to promote degradation of certain types of hot melt adhesives. Thus, the exposed surfaces of the frusto-cone may be provided with a nickel-plate on the order of 0.0003 to 0.0005 inch so as to take advantage of the good thermal transfer of copper while substantially negating the negative characteristics of the copper; this thickness is not critical so long as it is thin enough that cracking or flaking does not occur.

The base 43 of the heater block 17 is provided with two electrical resistance type heater elements 45 slip fit into bores 46, thereby providing the entire interior volume of the frusto-cone for heat transfer from the base 43 to the cone's flat face 47 and side wall 48. This establishes an efficient way of transferring heat to the frusto-cone's surface inside the barrel 14 without creating hot spots on that surface. Further, this heater block 17 structure by virtue of the high thermal conductivity of its material allows single point temperature control for the whole heated section of the gun, i.e., zone controls at different locations in the heater block 17 and/or barrel 14 are not necessary or desirable. The heater elements 45 are connected by suitable wiring, not shown, with power cord 49 in the gun's handle 13.

The base 43 of the heater block 17 is also provided with a longitudinal valve bore 50 having axis 53 that is parallel with the axis 15 of the frusto-cone 44 and barrel 14. This valve bore 50 is connected by main transfer bore 33 with the barrel 14, the bore 33 being of inverted Y-shaped configuration with arm **33*a* communicating with the upper portion of the barrel, and arm 33*b* communicating with the lower portion of the barrel, to prevent melt hangup in either the top or bottom of the barrel. The heater elements 53 are disposed on each side of the transfer bore 33 and valve bore 50. Molten feedstock is drained from the barrel 14 through port 51 adjacent the top of the barrel and through port 52 adjacent the bottom of the barrel, both of these ports being disposed adjacent the base of the frusto-cone 44. Since melt transfer bore 33 and discharge bore 50 are defined in the heater block 17 itself, and since the base 43 thereof is of substantial bulk relative to the volume of the bore 33, it will be understood that the molten feedstock is maintained at a substantially constant temperature as it is transferred from the barrel 14 to the nozzle 29**.

The cooling structure is in the nature of an annular cooling chamber 90. The cooling chamber is disposed coaxially with barrel 14 on the outside thereof just aft of the frusto-cone's face 47, see FIG. 1. The cooling chamber 90 cooperates with a coolant distribution bore 91 that runs axially of the housing 10 beneath the barrel 14. The distribution bore 91 communicates at one end through pressure drop port 92 with the cooling chamber 90, and intermediate thereof with threaded coolant inlet port 93. Inlet air supply line 94 extends through handle 13, and is threaded into port 93 and retained in operative combination therewith by nut 95. The distribution bore 91, at that end opposite the cooling chamber 90, opens onto an annular manifold chamber 96 through port 97.

Figure 7:
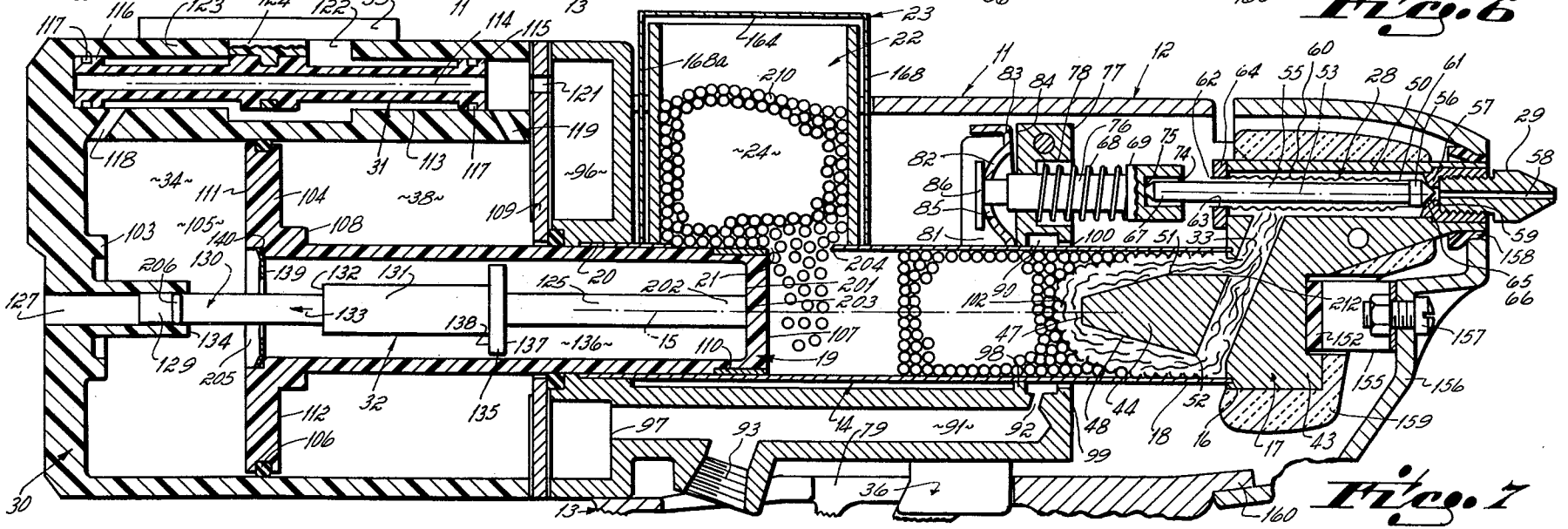
FIG. 7 is a cross sectional view similar to FIG. 6 but showing the gun's ram in the charging attitude.

The cooling chamber's pressure drop port 92 is especially sized, relative to the distribution bore 91, to provide metered flow of air from the bore 91 into the cooling chamber. Such is desired because of the maximum cooling effect created by an adiabatic expansion of the air on the barrel's outer surface as the air passes from a high pressure to an atmospheric pressure state (the cooling chamber 90 is at substantially atmospheric pressure because same is open through porting explained below to the gun's operating environment). The cool air so created by the pressure drop, and the concentration of that cool air in an annular ring just aft of the heater block's frusto-cone 44, controls the situs of the solid/melt interface 102 within the barrel 14 at a certain location interiorly of the cooling chamber 90 and prevents that interface from moving aft towards the barrel's charging port 21. With reference to FIGS. 6 and 7 it will be seen that the solid melt interface 102 contacts the barrel 14 within a converging channel defined between the conical shaped surface portion of the heater block 17 and the inside surface of the barrel. At the point at which it contacts the interior surface of the barrel, the interface of transition region 102 is subject to a force normal to the interior surface of the barrel. That normal force causes the solid portion of the interface to move radially outwardly and act as a physical dam against rearward flow of molten material past the dam. Because the solid/melt interface 102 is maintained with certainity inside the barrel 14 during use of the gun, the length of the barrel can be shortened to a minimum since no melt back of the interface ocurs along the barrel; that allows a short length feedstock charge (whether pellet or slug) to be used and, thereby, lessens the mechanical work required by the ram motor 30 to push the charge through the barrel.

In the case of a pelletized or granular feedstock, the material shows considerable tendency to expand radially when subjected to an axial force, causing substantial friction between the barrel and feedstock. Since this friction force is an exponential function of charge length, it is desirable to keep this length as short as possible.

Note that the barrel 14 is partially supported by annular rib 98 which defines the aft face of the cooling chamber 90. Note also that annular rib 99 which defines the fore face of the annular cooling air chamber is slightly spaced from the outer periphery of the barrel, thereby providing an annular port 100 which directs the cooling air axially forward along the exterior surface 18 of the barrel 14 to aid in the cooling of the barrel 14 and in the establishment of a large axial thermal gradient in the barrel 14 in the area adjacent to the frusto-cone 44.

The discharge valve 28 includes a valve stem 55 and a valve head 56 within valve bore 50, the valve head being adapted to seat against a valve seat 57 in sealing fashion. The valve seat 57 may be press fit or cast into the heater block's base 43, and the nozzle 29 is threaded into the seat 57. The nozzle's discharge bore 58 is axially aligned with the valve bore 50 and stem 55, and with hole 59 defined in the valve seat 57. A static seal in the nature of a compressible bellows 60 is fixed at one end 61 to the valve stem 55 adjacent the valve head 56, and is fixed at the other end 62 to the inner periphery 63 of a donut-shaped retained ring 64 fixed to the heater block's base 43. The bellows seal 60 functions to allow axial movement of the valve stem 55 (and, hence, of the valve head 56) on and off the valve seat 57 as allowed by the trigger assembly 36, while maintaining a seal to prevent leakage of molten feedstock through the aft end of the valve bore 50.

The valve head 56 is hyraulically unbalanced (note tapered face 65 of the head 56 that flares away from seating face 66 of the seat 57) such that the valve head and stem 55 will move rearwardly as viewed in FIG. 6 when no major compression spring 68 loaded abutment 69 is presented against the aft end 67 of the valve stem. Once the hydraulic pressure on the feedstock (as established by the ram 19) is sufficient to move the valve head 56, such rearward motion of the valve head allows molten feedstock to be discharged through the nozzle 29.

While the valve head 56 is hydraulically unbalanced relative to the valve seat 57 so that same moves axially rearward, i.e., so that the discharge valve opens, when the molten feedstock achieves a high enough hydraulic pressure, it may be desirable to provide a mechanical assist for opening the discharge valve. Such an assist can be established by stretching the bellows seal 60 on the order of 0.010 to 0.015 inch before assembly of the discharge valve 28, thereby giving it the characteristics of a tension spring as well as that of a seal. In this attitude, the bellows seal 60 itself, in combination with hydraulic pressure on the molten feedstock, functions to lift the valve head 56 from the seat 57 when the spring 68 loaded abutment 69 is removed from the valve stem's aft end 67.

Figure 8:
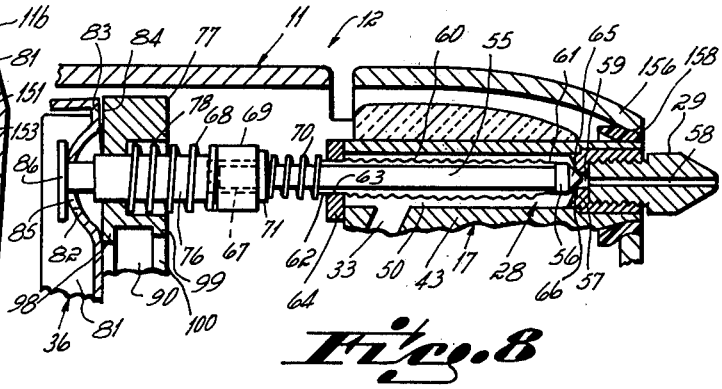
FIG. 8 is a cross sectional view similar to FIG. 1 showing an alternative embodiment of the gun's discharge valve structure.

Another structure for providing a mechanical assist in lifting the valve head 56 off the valve seat 57 is shown in FIG. 8. This alternative provides minor compression spring 70 which bears against flange 71 fixed to the valve stem 57 at one end and against the fixed retainer ring 64 at the other end. In other words, minor compression spring 70 partially opposes major compression spring 68. When the major spring 68 loaded abutment 69 is removed from the valve stem's aft end 67 in this embodiment, spring 70, in combination with hydraulic pressure of the molten feedstock, functions to lift the valve head 56 from the seat 57.

Another device to assist in lifting the valve head 56 off the valve seat 57 can be provided by a spring loaded mechanical catch which will engage a projection on the valve stem 67 near the end of travel of trigger 37. Said spring is designed to be strong enough to overcome resistance of the valve stem 53 but not so strong as to allow damage to the valve components.

Figure 5:
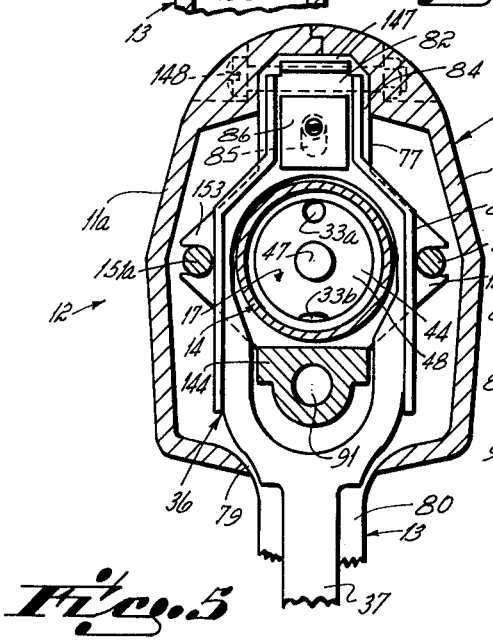
FIG. 5 is a vertical cross sectional view taken along line 5—5 of FIG. 1.

The gun's trigger assembly 36 is particularly illustrated in FIGS. 1 and 5. The trigger 37 is adapted to cooperate with the major spring 68 loaded abutment 69. The trigger 37 functions only to withdraw the abutment 69 against the spring 68 bias, thereby allowing the discharge valve 28 to open due to hydraulic pressure of the molten feedstock only (or as assisted by placing the bellows seal 60 in tension or by the minor spring 70 structure shown in FIG. 8). The spring 68 loaded abutment 69 is in the nature of a cup 74 within which the valve stem 55 is slidingly received, the stem's aft end 67 abutting the cup's floor 75 when the discharge valve 28 is closed. The cup 74 is mounted on a shaft 76 which is slidingly received in bracket 77, the bracket being in a fixed or immobile position. The bracket 77 defines a well 78 within which the major compression spring 68 is seated, the spring 68 hearing against the underside of the cup 74 so as to continuously urge same forward toward the nozzle 29, i.e., so as continuously to bias the discharge valve 28 toward the closed attitude where valve head 56 is seated on valve seat 57.

The trigger 37 extends through slot 79 in the housing 11, the trigger being protected against inadvertent contact in the usual manner by trigger guard 80 formed integral with the housing's barrel portion 12 and handle 13. The trigger 37 is mounted to the base of an oval yoke 81 that surrounds the barrel 14, see FIG. 5. A thumb 82 extends up from the oval yoke 81 into proximity with the reciprocable abutment's bracket 77. The trigger's thumb 82 defines an elongated slot 85 through which the abutment's shaft 76 passes, a plate 86 being fastened onto the shaft 76 so that the trigger's thumb is captured on the shaft 76 between the plate and the bracket 77. Hence, the trigger 37 itself simply hangs on, i.e., is not directly connected to, the abutment's shaft 76. This lost motion kind of connection eliminates potential binding of the shaft 76 within the bracket 77 as the shaft reciprocates linearly therein in response to trigger operation. Binding of the shaft 76 within bracket 77 would be normally expected to occur if the trigger 37 were directly connected to the shaft 76 since the trigger moves in an arcuate path as opposed to the shaft's linear path.

To remove the cup-shaped abutment 69 from contact with the valve stem's aft end 67 (so that the discharge valve 28 can open), the trigger 37 is pulled rearwardly by an operator's index finger, causing the trigger's thumb face 83 to bear against aft face 84 of the abutment's bracket 77, thereby causing the cup 74 to be drawn rearwardly against the bias of compression spring 68 since the trigger's thumb 82 is captured on the abutment's shaft 76 and bears against the plate 86. When the operator releases the trigger 37, compression spring 68 moves the cup 74 into abutting contact with the valve stem 55. Since compression spring 68 is quite strong relative to the opening forces (hydraulic and/or spring) on the valve head 56, the discharge valve 28 is closed when the trigger is released. Because there is no positive mechanical connection between the trigger assembly 36 and the discharge valve 28, no matter how hard an operator may depress the trigger 37 it will not cause any mechanical structure to bear on the discharge valve itself.

The pneumatic motor 30 is, in essence, a piston head 104 fixed to and molded integral with the ram 19. The ram and piston head are fabricated of a thermally conductive material, thereby providing an efficient heat transfer path for conduction of heat away from face 107. The piston head 104 is located within motor chamber 105, that chamber 105 being divided into first sub-chamber 34 and second sub-chamber 38 by the piston head. O-ring 106 on the outer periphery of the piston head 104 insures the integrity of the sub-chambers 34, 38 one from the other. The ram 19 itself defines a hollow interior 136 that is continually opened to sub-chamber 34 through port 205 in piston head 104. This allows an additional degree of cooling to be achieved throughout the ram's length, and particularly at the inside face 201 of the ram, since the combination of the ram's linear reciprocatory motion within chamber 105 and pressurized inlet air within sub-chamber 34 introduces an air flow within the ram's interior. Of course, the exterior of the ram 19 is provided with a degree of cooling through the air flow within sub-chamber 38.

A solid ram 19 would allow superior conduction of heat away from face 107; however, a hollow ram 19 is illustrated in FIGS. 1, 6 and 7 so as to provide space for the telltale indicator 32.

Note that the ram 19 and piston head 104 are axially aligned with the barrel 14. Thus, air pressure on face 111 of the piston head 104 extends the ram 19 toward the heater block 17, and air pressure on face 112 of the piston head retracts the ram away from the heater block 17, with no loss in mechanical energy transfer from the piston head to the ram. Note also that the outside diameter W of the ram 19 is substantially identical to the inside diameter W′ of the barrel 14, the ram thereby acting as a closure for the the barrel's charging port 21 as the ram is extended through the barrel. Note also that the axial length L of the ram 19 is not as great as the length L′ of the barrel 14 between the ram's face 107 and the frusto-cone's face 47 when the ram is fully retracted as shown in FIG. 1. This, of course, prevents the ram's face 107 from contacting the frusto-conical heater's face 47 when the ram 19 is fully extended. When fully extended, the stop flange 108 on the ram 19 engages plate 109 (which forms one side face of the control air chamber 96) to form a positive limit stop of the ram's forward motion. Further, the motor chamber 105 is provided with an annular rib 103 adapted to function as an aft stop for the piston head 104, i.e., for the ram 19, when it is in the fully retracted position shown in FIG. 1. Note also that the area of piston head 104 is substantially larger than the area of ram face 107 acting to form a pressure intensifier and allowing the generation of large unit pressures at ram face 107 from low pressure plant air supplies.

The piston head 104 and ram 19 may be formed of a high heat conducting material such as aluminum, if desired. Such promotes heat transfer away from the ram's face 107 back along the ram where it can be dissipated through the inlet air circulating inside and outside of the ram in motor chamber 105. However, the piston head 104 and ram 19 also may be formed of a molded plastic if desired. This is because of the cooling provided for the barrel 14 aft of the frusto-cone 44 by the exhaust air from the cooling chamber 90, and because of the interior and exterior cooling of the ram 19 through the ram motor 30. It should be understood that a ram of plastic or other thermally nonconductive material limits the useful upper operating temperature of the device and/or the allowable closeness of approach of ram face 107 to face 47 of the heater. However, if the ram 19 is formed of a plastic, and especially in that embodiment where a hopper 22 for powder or pellets is used, it is desirable that the outer periphery of the ram's face 10 be provided with a steel ring insert 110. This steel ring insert 110 functions to shear off any pellets or granules hung up in the charging port 21 as the ram 19 progresses from the fully retracted attitude illustrated in FIG. 1 toward an extended attitude illustrated in FIG. 6. In the hopper 22 embodiment, not that the charging port 21 is circular in configuration, and that the ram's face 107 is transverse to the barrel's axis, thereby minimizing the shearing force required since only a few such pellets will be sheared off at a time; this aids in prevention of ram 19 hang up or sticking of the barrel 14 as it is extended forward.

A control valve in the form of a spool valve 31 is provided for the pneumatic motor 30. The spool valve 31 is interposed between the manifold chamber 96 and the motor chamber 105 along the top of the gun housing's barrel portion 12, see FIG. 1. The spool valve 31 is adapted to slide axially within spool valve bore 113, that bore having an axis 114 disposed parallel to but spaced from the ram and barrel's axis 15. The spool valve includes a lip 115, 116 at each end thereof, the annular periphery of each lip being provided with an O-ring 117 to maintain operating pressure and integrity between the manifold chamber 96, and between the two sub-chambers 34, 38 of the motor chamber 105. Port 118 interconnects one end of the spool valve bore 113 with sub-chamber 34 of the motor chamber 105, and port 119 connects the opposite end of the spool valve bore with sub-chamber 38 of the motor chamber 105. Transfer bore 120 extends axially of the spool valve 31 from one end thereof to the other. The transfer bore 120 serves to interconnect the manifold chamber 96 (through port 121 in plate 109) with the sub-chamber 34 of motor chamber 105 through port 118 when the spool valve 31 is oriented as shown in FIG. 1, thereby allowing the ram 19 to be extended toward the heater block 17. The manifold chamber 96 is exposed to sub-chamber 38 of the motor chamber 105 through port 119 when the spool valve is positioned as shown in FIG. 7, thereby allowing the ram 19 to be retracted into the charging attitude.

The control valve's handle 35 is mounted on the spool valve 31 through slot 122 in the spool valve's housing 123, that interconnection being accomplished by use of web 124. Hence, an operator causes ram 19 to extend by stroking spool valve 31 forwardly thrugh use of handle 35 when high pressure air is applied to mainfold chamber 96. Conversely, an operator causes ram 19 to retract by stroling spool valve 31 rearwardly through use of handle 35. Thus, the control valve for the pneumatic motor is oriented so that forward motion of the handle 35 extends the ram 19 into a pressurized condition, and rearward motion of that handle 35 retracts the ram into a feedstock charging position, thereby making operation of same readily and easily understandable to the operator.

The telltale rod 32 is slidingly received within telltale bore 127 formed in the motor chamber's housing 128, that bore 127 being coaxial with the axis 15 of the ram 19 and barrel 14. O-ring 206 is provided to prevent leakage of air from sub-chamber 34 to the environment through that bore 127. The telltale rod 32 also extends into the hollow interior 136 of the ram 19. The telltale rod 32 is adapted to move between an outer position (shown in FIG. 1) where tip 129 thereof is visually exposed to an operator and an inner position (shown in FIG. 6) where tip 129 is removed from the operator's vision. As mentioned, when the telltale rod's tip 129 is retracted into the housing, the operator knows it is time to recharge the barrel 14.

The telltale rod 32 comprises a four-part stem, the aft section 130 carrying the visual indicator in the form of tip 129. The intermediate section 131 provides a stop lip 132 which limits the telltale rod's outward motion in direction 133, that lip 132 abutting against annular collar 134 when the rod 32 is fully extended as shown in FIG. 1. The guide section in the form of a circular plate 135 is axially mounted on the rod 32 between the intermediate section 131 and the fore section 125. The fore section is of a length that allows its face 203 to abut the ram's inside face 201.

When high pressure air is exposed to sub-chamber 34 through spool valve 31, same moves through port 205 past catch ring 139 into the interior 136 of the ram 19. When the ram 19 is in an intermediate extended attitude as illustrated in FIG. 7, this air pressure keeps the telltale rod 32 extended outwardly beyond the gun's housing 11 (as shown in FIG. 7) to indicate that feedstock recharging is not yet permitted because of the differential air pressure force exerted on the telltale 32, the pressure in sub-chamber 34 being substantially greater than ambient. However, as the ram 19 moves forwardly, i.e., is extended, the catch ring 139 (which is press fit into seat 140 defined in face 111 of piston head 104) engages annular surface 138 on the circular plate 135, thereby pulling the telltale rod 32 inwardly into the motor chamber 105. Thus, and when the ram 19 has reached the attitude illustrated in FIG. 6, same indicates that feedstock recharging is permitted since the telltale rod's tip 129 will have disappeared into guideway 127.

The barrel 14 itself is of a cylindrical shape, and should be fabricated of a material, e.g., stainless steel, with a low thermal conductivity to establish a high temperature gradient axially along its length. The barrel is carried within the gun's housing 11 by being trapped between the housing's two halves 11*a*, 11*b*, i.e., by being seated as at 16 in the heater block 17, by being supported by annular rib 98, and by being seated as at 145 in housing 146 of the manifold chamber 96. The housing's halves 11*a*, 11*b* are in the nature of castings which include the pistol grip 13 and trigger guard 80. The manifold chamber housing 146 is interconnected by a web 144 with the cooling chamber housing 147 (which housing 147 includes bracket 77 and the cooling chamber 90), the distribution bore 91 passing through the web 144. Assembly plate 109 also defines the housing 146 for the manifold chamber 96. The housing 123 for the spool valve 31 and the housing 128 for the motor chamber 105 are a single casting, that casting and the plate 109 being held to the two half castings 11*a*, 11*b* by means, not shown.

Figure 3:
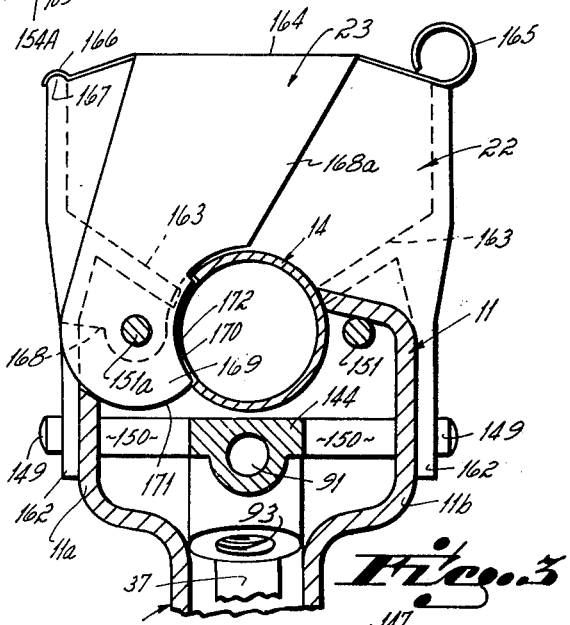
FIG. 3 is a cross sectional view taken along line 3—3 of FIG. 1 showing a hopper structure for powder or pellet type feedstock.

The two halves 11*a*, 11*b* of the housing 11 are tied together at the top by bolt 148 as shown in FIGS. 1 and 5, and are tied together at the bottom by bolts 149 (which also hold the hopper 42 in place on the barrel 14 as shown in FIG. 2) received in spacer wings 150 cast integral with the web 144 that defines distribution bore 91 as shown in FIGS. 2 and 3. These machine bolts 148, 149 hold the housing halves 11a, 11*b* together from side to side. A tire rod bolt 151 is located on each side of the barrel 14 in the same horizontal plane. Each tie rod bolt 151 passes through load plate 152 that seats the heater block 17 against the fore end 18 of the barrel 14, each passes through an ear 153 defined on the side of the housing 147 for the cooling chamber 90, each then passes through a hole 154 in housing 146 and is in engagement with a tapped hole 154A defined in plate 109 for the manifold chamber 96 (see FIGS. 2 and 5). The tie rod bolts 151, at the fore end thereof, also connect a mounting bracket 155 to the interior assembly. The nose section 156 of the gun's housing 11 is connected to the housing halves 11*a*, 11*b* through bolt 157 which holds that nose section to the mounting bracket, see FIG. 2. Note that the housing's nose section 156 is seated on annular lip 160 defined by the leading edge of the housing's halves 11*a*, 11*b*, see FIG. 2.

The nozzle 29 protrudes through the nose section 156, and an insulating ring 158 is disposed between the heater block 17 and the nose section at that point to prevent heat transfer from the heater block to the housing 11. Further, and within the nose section 156 of the housing 11, insulation 159 is wrapped around the heater block's base 43 to maintain the heat within the heater block 17 and to insulate the housing 11 from the heater block.

That embodiment of the hand gun 10 adapted for use when the feedstock is in pellet or powder form is particularly illustrated in FIGS. 1–4, 6 and 7. As shown in those Figures, and as mentioned before, hopper 22 is fixed to the gun's housing by bolts 149 that restrain the hopper's side ears 162 (and, therefore, the hopper) in operative combination with the barrel 14 over the charging port 21. The hopper 22 is in the configuration of an open top mouth having interior bottom walls 163 flared inwardly toward the barrel. These bottom walls 163 terminate adjacent the arcuate shaped charging port 21 so as to direct the powder or granules into the barrel 14.

The hopper 22 is provided with safety structure in the form of lid 23 that cannot be opened unless the ram 19 is fully retracted, and that prevents the ram from being extended once the lid is opened. The safety lid 23 includes a hopper cover 164 having a handle 165 along one edge, and a lip 166 along the other edge. The lip 166 is adapted to cooperate with a rounded top edge 167 of the hopper 22, thereby serving as a latching device to maintain the lid closed as shown in FIG. 3. The front and rear edges of the cover 164 are each provided with an arm 168 that extends downwardly adjacent the barrel 14, see FIGS. 2 and 3. Each of these arms 168 is pivotally mounted to the same tie rod 151*a* that runs axially in parallel fashion along the barrel, thereby allowing the lid to pivot between closed and opened attitudes under certain condition, compare FIGS. 3 and 4.

Figure 4:
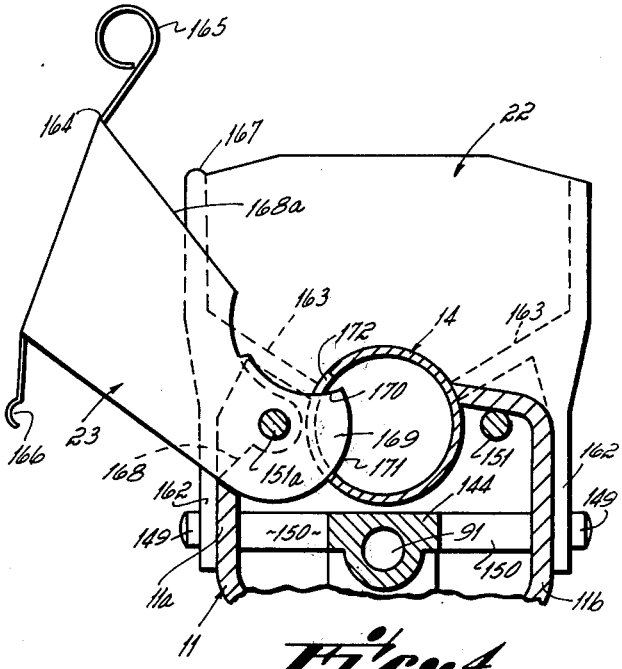
FIG. 4 is a cross sectional view similar to FIG. 3 but showing the gun's hopper lid in the open or charging attitude.

However, the lid's rear arm 168*a* is configured differently than the lid's front arm 168*b*, see FIGS. 2–4. The rear arm 168*a* (located aft of the charging port 21) is provided with an abutment in the form of extension 169 configured as shown in FIG. 3. The extension 169 has an inner edge 170 that is concave shaped to coincide with the barrel's configuration when the cover 164 is closed (see FIG. 3), and has an outer edge or segment 171 adapted to move into the barrel's interior (through slot 172 formed in the barrel 14 and located aft of the charging port 21) when the cover is opened (see FIG. 4). This extension or abutment 169, which is part of arm 168*a*, is a safety device as it will be apparent that the cover 164 cannot be opened (because the extension 169 cannot move into the barrel's interior) after the ram's face 107 has passed the slot 172 defined in the barrel, compare FIGS. 1 and 7. This, of course, means the hopper's cover 164 can only be opened by an operator when the ram 19 has been fully retracted as shown in FIG. 1, at which position the barrel's slot 172 is exposed so that extension 169 can move into the barrel's interior. Further, and when the cover 164 is opened for recharging the hopper 22, the ram 19 cannot be extended forward in the barrel toward intermediate positions shown in FIGS. 6 and 7 because extension 169 acts as a positive stop by engaging the ram's face 107. This occurs, of course, because extension 169 is always disposed interiorly of the barrel 14 when the cover 164 is open, see FIG. 4.

Figure 9:
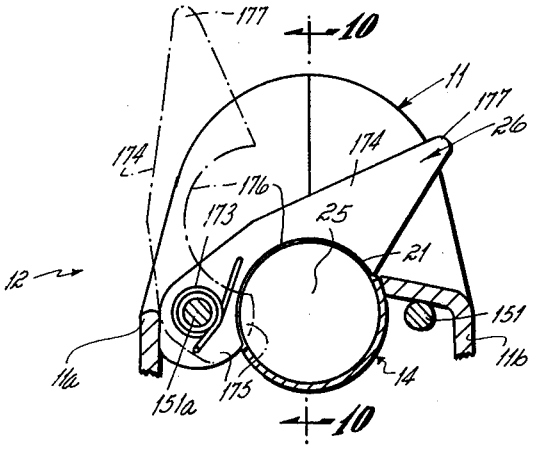
FIG. 9 is a cross sectional view similar to FIG. 3 showing an alternative cover structure for a slug type feedstock where the gun is adapted to carry only one slug at a time, the cover structure being shown closed in solid lines and open in phantom lines.
Figure 10:
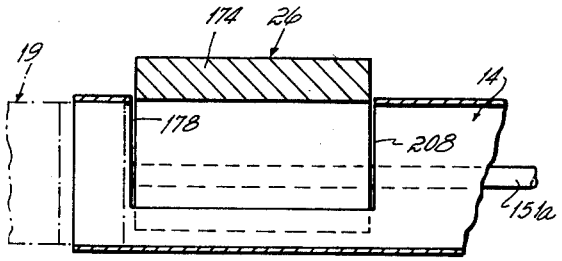
FIG. 10 is a cross sectional view taken along lines 10—10 of FIG. 9.

That embodiment of the hand gun 10 adapted to be charged with one slug at a time is illustrated in FIGS. 9 and 10. As shown in FIG. 9, there is no hopper 22 when the gun 10 is adapted to be charged with feedstock slugs. A single slug 25 is simply loaded directly into the barrel 14 when the charging port's cover 26 is in the phantom line or open position illustrated in FIG. 9. Note, of course, that the charging port 208 must be sized to receive a slug having a generally cylindrical configuration with an outside diameter no greater than the inside diameter of the barrel 14, i.e., the port 208 is not circular as was the case with charging port 21 for the pellet or powder embodiment.

The cover 26 is pivotally mounted on tie rod 151*a*, and is spring 173 biased continually toward the closed or solid line position shown in FIG. 9. The cover 26 includes a lid 174 section and an elbow 175 section, the lid section having an inner surface 176 that is concave shaped to coincide with the barrel's outer periphery when the cover is closed. The cover 26 can only be pivoted open (by gripping nose section 177) to the phantom line position shown in FIG. 9 when the ram 19 is retracted past the charging port 208 because the cover's extension section 175 must be able to move into the barrel's interior through the charging port as the cover is open. Once the cover 26 has been closed, it cannot be opened after the ram 19 passes the aft edge 178 of the charging port 208 because the ram itself will prevent extension 175 from entering the barrel's interior. Further, the cover 26 cannot be reopened once a lug 25 has been placed through the charging port 21 into the barrel 14 until the slug has passed the fore edge 179 of the charging port; this because the cover's extension 175 would contact the slug if opening of the cover was attempted.

Figure 11:
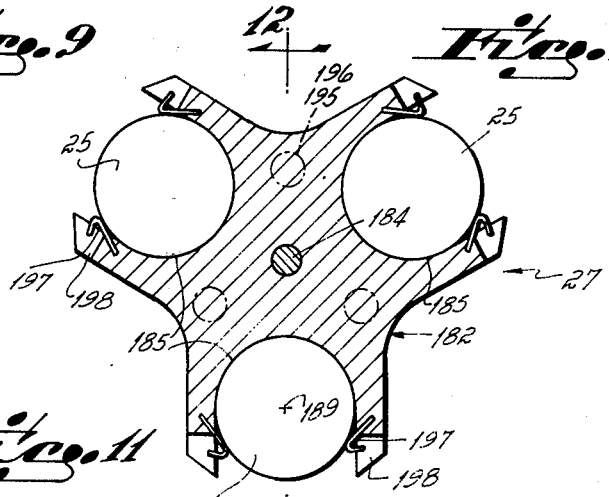
FIG. 11 is a cross sectional view similar to FIG. 9 showing another alternative cover structure for a slug type feedstock where the gun is adapted to carry multiple slugs.
Figure 12:
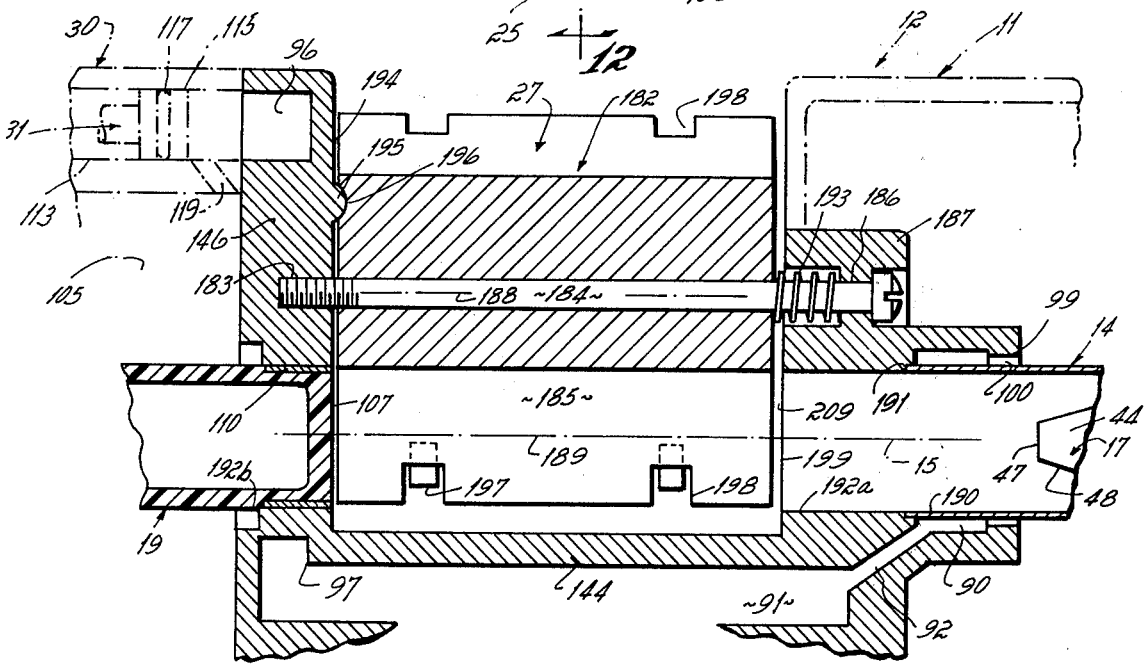
FIG. 12 is a cross sectional view taken along line 12—12 of FIG. 11.

That embodiment of the hand gun 10 adapted to be charged through use of a multiple slug turret 27 is illustrated in FIGS. 11 and 12. The turret 27 includes cylinder 182 having three pockets 185, the cylinder being mounted for rotation on bolt 184. The bolt 184 is threaded into tapped hope 183 in housing 146 for the manifold chamber 96, and is received in hole 186 in frame section 187. Note that the cylinder 182 rotates on axis 188 that is parallel to the barrel's axis 15, the cylinder's rotational axis 188 also being parallel to the slug's axes 189 when same are seated in pockets 185. Note, also, in this multiple slug turret 27 embodiment that the turret pockets 185 function as a rearward extension of the barrel (the barrel's aft end 190 stops forward of the turret and is seated as at 191 in frame section 187. Major bores 192*a*, 192*b* in the frame section 187 are axially aligned with the barrel 14 and the ram 19, thereby presenting a single barrel configuration in cooperation with successive pockets 185 in cylinder 182.

Cylinder 182 is spring 193 loaded against the front face 194 of frame section 146, and a detent 195 type latch is formed on that face 194 to cooperate with depression 196 on the cylinder. This detent 195/depression 196 type latch functions to maintain the cylinder 182 in proper operating attitude where a slug's centerline 189 is coaxial with the centerlines of the barrel and ram. Spring clips 197 set in grooves 198 adjacent each pocket 185 maintain the slugs 25 in seated engagement with the cylinder 182, and insure alignment of the slugs with the barrel 14 when each is turned into axial alignment therewith.

The turret 27 cannot be rotated relative to the barrel 14 unless the ram 19 is in the totally retracted position shown in FIG. 12. This for the reason, of course, that ram 19 extends into a pocket 185 of the cylinder 182 during use of the gun 10. Once the ram has been fully retracted, and if the slug previously within the charging port 21 area has been pushed past fore edge 199 of the frame section's charging port 209, then the cylinder 182 can be manually rotated by an operator to place a new slug 25 in axial alignment with the gun's barrel and ram. Of course, the exposed pocket 185 that has been previously emptied may then be refilled with a new slug by the operator simply by pressing same down into that pocket beyond spring clips 197. Note that, even when all pockets 185 are emptied of slugs 25, it is still not possible for an operator to present his fingers into the barrel because the turret 27 also functions as a revolving door that always keeps the barrel's interior closed to the environment.

DETAILED OPERATION

In connection with operation of the hand gun 10 illustrated, the barrel 14 thereof is first filled with a charge of thermoplastic material, e.g., a hot melt adhesive; this charge may be made in either powder or pellet form, or in slug form. If powder or pellets are used as the feedstock, the hopper 22 and safety lid 23 are used in combination with the barrel, see FIGS. 1–4, 6 and 7. If slugs are used as the feedstock, and if the gun is of the single slug type, a safety cover 26 is used as shown in FIGS. 9 and 10; if the gun is of the multi-slug type, a safety turret 27 is used as illustrated in FIGS. 11 and 12.

When pellets 210 or powder is used as the feedstock, the ram 19 must be in the fully retracted attitude prior to opening the hopper's cover 164 and charging the barrel 14, see FIG. 1. The hopper's cover 164 is then pivoted counter-clockwise (see FIG. 3) on tie rod bolt 151*a* by grasping handle 165 and disengaging detent 166 from the hopper's shoulder 167. Such a pivotal or lid opening motion is permitted when the ram 19 is retracted because extension 169 of the arm 168*a* can move into the barrel's interior through vertical slot 172, see FIG. 4. In this open cover 164 attitude the powder or pellet feedstock is poured into the hopper 22, a first charge of same passing through the barrel's charging port 21 into the barrel 14, and the hopper then being filled to the rim for further charges. The cover 164 is then pivoted closed until detent 166 latchingly engages rim 167 of the hopper itself, the stop or extension 169 thereby being withdrawn out of the barrel interior. It will be recalled that the cover 164 cannot be opened once the ram 19 begins to extend because extension 169 of the lid's arm 168*a* will no longer be movable into the barrel's interior through vertical slot 172. Thus, the hopper's cover 164 cannot be opened to expose the charging port 21 if the ram 19 is forward in an operating position and, conversely, the ram cannot be moved forward if the hopper's cover is open. Further, once the cover 23 is open, extension 169 acts as a limit stop to prevent forward motion of the ram 19. This forces the operator to go through the proper feedstock charging sequence so that he cannot get his finger caught in the barrel 14 by the ram 19.

When the single slug version of the hand gun is to be charged, the safety cover 26 must be pivoted counter-clockwise (see FIG. 9) about tie rod 151*a* against the bias of spring 173 into the phantom line position illustrated in FIG. 9. In that open attitude, the extension 175 of the cover 26 extends into the barrel's interior through charging port 208. As with the hopper cover 23 embodiment, such is only possible when the ram 19 is fully retracted, i.e., the safety cover 26 can only be opened when the ram is fully retracted. When the cover 26 is opened, a slug 25 is positioned within the barrel 14 through the charging port 208. Note that the cover 26 and barrel 14 more or less define a V-shaped funnel in cross section to guide the slug into place within the barrel, the cover snapping closed (because of the spring 173 bias) over the slug once the slug is fully within the barrel. The cover 26 cannot be opened when the ram 19 is partially or fully extended in the barrel because the ram intercepts extension 175 as it is pivoted toward the barrel's interior. Further, if there is still a slug within the charging port 21 area, the lid cannot be opened either because of the fact that the extension 175 extends the length of the lid. Further, once cover 26 is open, extension 175 acts as a limit stop to prevent forward motion of the ram 19. As with the hopper cover 23 embodiment, this structure forces the operator to go through the proper feedstock charging sequence so that he does not get his finger caught in the barrel by the ram 19.

When the multi-slug version of the hand gun 10 is to be charged, the cylinder 182 is simply rotated about axis 188 with a slug 25 being inserted into each pocket 185 of the cylinder, see FIGS. 11 and 12. The slugs 25 are retained in successive pockets 185 by spring clips 197 fixed to the cylinder 182. The cylinder 182, after being filled, is rotated until a slug 25 is rotated through charging port 209 until it is positioned in axial alignment within the barrel 14. Axial alignment of the slug 25 and barrel 14, even though hidden from the operator's view, is insured because of the detent 195/depression 196 latch device. Of course, the turret 27 cannot be rotated once the ram 19 has been partially extended because the ram passes through the cylinder's pocket 185 that carries the slug 25 in process. Further, the ram 19 cannot be extended unless a pocket 185 is axially aligned with ram 19. No special safety structure is required in this embodiment because it is inherent in the turret's structure. Access by an operator's fingers into the barrel 14 is prevented at all times since the cylinder's configuration, even when the gun 10 is making use of the last slug in the cylinder 182, always closes the barrel's interior to the environment.

As mentioned, the ram 19 must be fully retracted to allow charging of the barrel 14 through the charging port 21 with either powder, pellets or slug type feedstock. Motion of the ram 19 is controlled by spool valve 31 as manually positioned through use of handle 35. The spool valve 31 is hollow (because of transfer bore 120) so that the spool valve acts not only as a valve to direct flow to either port 118 or port 119, but also as a means of transmitting pressurized inlet air from the manifold chamber 96 to the sub-chamber 34 through bore 120 when it is desired to extend the ram.

The spool valve 31 is set up so that the sense of direction of operation of the control valve's handle 35 is the same as the direction of ram 19 travel. Retraction of the spool valve 31 into that attitude shown in FIG. 7 causes the ram to be retracted as pressurized inlet air from manifold chamber 96 is directed through port 119 into sub-chamber 38 of the pneumatic motor 30. This forces the piston head 104 rearwardly with exhaust air in sub-chamber 34 being passed through port 118 into spool valve bore 113 and then out through slot 122 to the atmosphere. Discharge of the exhaust air from sub-chamber 34 is diffused as it passes into the atmosphere because it exhausts between handle 35 and the housing 123 for the spool valve chamber, thereby preventing possible injury to an operator from the air blast. When it is desired to extend the ram, the spool valve's handle 35 is stroked forward so that pressurized inlet air from manifold chamber 96 is directed through transfer bore 120 and through port 118 into sub-chamber 34. This forces piston head 104 forwardly with the exhaust air from the sub-chamber 38 being passed to atmosphere through port 119, spool valve bore 113 and out through slot 122. As the exhaust air passes out the slot 122, it, too, is baffled by the handle 35.

When the ram 19 is retracted, the inside face 201 of ram 19 contacts fore end 202 of telltale rod 32, see FIG. 7. As the ram 19 retracts, therefore, the telltale rod 32 is forced aft until the telltale rod 32 stops against the collar 134 on the housing 128 for the motor chamber 105 (which in turn stops the piston head 104), thereby visually exposing the telltale rod's tip 129 to an operator and locating the ram 19 in the charging attitude. As the ram 19 is extended or moved forward, it will be recalled that pressurized inlet air is in sub-chamber 34 and this pressurized air passes into the hollow interior 136 of the ram 19. Because of the pressurized air acting on telltale rod 32, the rod will not move forward toward the gun's nozzle 29 end until catch ring 139 actually engages flange 135. In other words, and prior to catch ring 139 engaging flange 135, if an operator pushed inwardly on the telltale rod 32 it will always pop back out. Thus, the catch ring 139 interengages the telltale rod's flange 135 as the ram 19 reaches an intermediate extended position and, thereafter, pulls the telltale rod inwardly with it as the ram 19 continues to move forward, see FIG. 6. Once the tip 129 of the telltale rod 32 disappears into the gun housing's interior, same visually indicates to the operator that recharging of the barrel 14 is permissible since the ram's face 107 will have passed the fore edge 204 of charging port 21, see FIG. 6.

When the ram 19 moves forward under the pressurized inlet air in sub-chamber 34, same compresses the powder or pellets, or slug into engagement with the frusto-conical portion 44 of the heater block 17. Generally speaking, 40–60 psig in the sub-chamber 34 has been found adequate to provide the necessary hydraulic pressure for the usual high melt adhesive in commerce today. Indeed, certain high melt adhesives can be adversely affected by too great a hydraulic pressure in the sense that they may tend to flow even though cold; such would tend to cause binding of the ram 19 within the charging port 21 area of the barrel 14 and the generation of high radial forces creating large friction forces between the feedstock and the barrel 14.

As the feedstock moves into proximity with the frusto-cone 44, it is melted beginning at a solid/melt interface 102. The frusto-cone 44 configuration is highly effective in that the cones face 47 presents a large surface area for melting pruposes relative to the cross sectional area of the barrel 14, in that it provides a consistent thermal gradient along its axis from heater base 43 to face 47, because of the heater elements 45 being in the heater blocks base 43, and in that the molten material flows away from the interface 102 around the cone's sides 48 as subsequent feedstock is moved up toward the frusto-cone. Thus, as the feedstock is pushed toward the frusto-cone 44, the molten feedstock 212 is flowed radially outward from the cone's axis, and is then collected in and directed through the annular passage between the frusto-cone's sides 48 and the barrel 14. The frusto-cone's sides 48 tend to flare both the molten solid feedstock out against the inner wall of the barrel 14 where a dam or interface 102 is formed because that wall has a steep thermal gradient over it. The wedging action of the frusto-cone 44 coupled with the chill on the barrel's outer periphery, in effect, provides the solid/melt interface 102 seal that is retained just aft of the heater block 43. This self-damming or interface 102 forming function is particularly critical (and is accomplished) even with slug type feedstock where the slugs are not of a good initial fit with the barrel. This interface 102, and the maintenance of same just aft of the heater block prevents melt back into the charging port 21 area of the barrel 14 and allows the use of the high hydraulic pressures which are needed to flow the more viscous high performance adhesives out of the solid/melt interface promoting good flow rates and allowing higher melt rates.

As previously noted, the annular cooling chamber 90 materially aids in maintaining the solid/melt interface 102 just aft of the heater block 43 as it is through use of such that the thermal gradient over the barrel's wall is established. Although there is not too much of a melt back problem even with a relatively warm barrel 14 wall as long as the powder or pellets or slug continually move through the gun, melt back does become a problem when the gun's discharge valve is closed and no feedstock is being dispensed, i.e., at a steady state soaking condition, such as would occur during feedstock recharging or breaks in the work day. The essence of the melt back problem is that the solid/melt interface 102 tends to travel backward through the barrel 14 toward the charging port 21 area. Such is prevented by the cooling chamber 90, the coolant being provided by a portion of the pressurized inlet air introduced into the distributor bore 91 through air line 94, that air passing by choked flow through port 92 into the cooling chamber 90 so as to produce a relative cold coolant about the barrel 14 just aft of the frusto-cone's face 47. Further, the fact that housing wall 98 of the cooling chamber is in direct thermal contact with the outside of the barrel 14 also tends to reduce heat transfer back along the barrel. In addition, the cooling air is exhausted from chamber 90 through annular port 100 and directed axially forward along the outside surface of barrel 14 toward heater block 43, providing additional cooling of the barrel. Note that the wall thickness of barrel 14 is kept to a minimum to first reduce the heat transfer away from heater block 43 and, second, to reduce the thermal resistance radially to ease cooling of the feedstock circumference. The location of the cooling chamber 90 just aft of the frusto-cone's face 47 is about as far forward as it is desirable to have the cooling chamber. Any further forward and the effect is one of putting heat into the system behind or aft of the cooling area. Further, it is desirable not to have the cooling chamber 90 any further back along the barrel 14 because it is desirable to minimize the length of the barrel which is hot. Of course, for a given air pressure available through the line 94, the size of the port 92 controls the flow rate into chamber 90. In establishing the choked flow state for the maximum cooling effect, it is necessary that the pressure in distributor bore 91 be in the ratio of 1.92 to ambient and that the majority of the pressure drop occur across port 92.

After the feedstock has turned molten, it is directed into the discharge valve bore 50 through heater block bore 33, the melt 212 being forced from the barrel through top 51 and bottom 52 ports. The molten feedstock is discharged when desired by an operator through operation of a trigger assembly 36 that cooperates with the discharge valve 28. In use, and as the trigger 37 is drawn rearwardly by the operator's index finger, cup 69 is drawn rearwardly against the forward push of major spring 68. This frees the cup 69 from abutting engagement with the aft end 67 of valve stem 55. This, in turn, allows hydraulic pressure on the valve head 56 (in combination with the spring assist from bellows seal 60 if that is used, or in combination with the spring 70 assist from that embodiment illustrated in FIG. 8 if that is used) to lift the valve head 56 off the valve seat 57. When valve head 56 lifts off the valve seat 57, molten feedstock discharges through orifice 58 in nozzle 29. That is, molten feedstock 212 will issue from the gun's nozzle 29 only if the melt pressure within the valve bore 50 is sufficient to cause the valve stem 55 to move rearwardly along axis 53. When such occurs, and as long as the trigger 37 is retracted by the operator's index finger, molten feedstock will issue from the nozzle 29 onto a workpiece as desired.

When it is desired to terminate issuance of molten feedstock from the nozzle 29, the trigger 37 is simple released. Because major compression spring 68 creates substantially greater pressure than the hydraulic pressure (and, also, greater pressure than the hydraulic pressure in combination with the bellows seal 60 pressure and/or the minor spring 70 pressure), the spring loaded abutment 69 is pushed back into contact with the valve stem's aft end 67. This, of course, causes the valve head 56 to once again be seated on the valve seat 57 and, thereby chokes off the flow of molten feedstock. It is to be noted that the discharge valve 28 is actuated independently of the trigger assembly 36 once the spring loaded abutment 69 has been withdrawn from abutting contact with the valve stem 57. No matter how hard an operator may depress the trigger, it will not mechanically bear on the discharge valve 28 components and, therefore, cannot cause damage to any valve 28 part especially, e.g., the sensitive bellows seal 60.

The compression spring 68 is of a strength such that above a predetermined pressure, e.g., 400 psig, and even with the spring loaded abutment 69 contacting the valve stem's aft end 67, the hydraulic pressure in the discharge valve bore 50 (in combination with the bellows seal pressure and/or in combination with the minor spring 70 pressure, if either is used) will provide sufficient force to overcome the compression spring 68 so as to force the discharge valve 28 open. Thus, and if for any reason the system becomes blocked and excessively high pressure starts to develop in the discharge valve 28 area, the discharge valve will be self-relieving and allow the pressurized molten feedstock to exhaust out the nozzle 29.

Having described in detail the preferred embodiment of our invention, what we desire to claim and protect by Letters Patent is:

1. In a device adapted to translate a feedstock such as a thermoplastic adhesive from a solid state to a molten state, the improvement comprising a barrel having a charging port, a ram reciprocable relative to said barrel, said ram being adapted to force the feedstock toward the fore end of said barrel, and a heater block at least partially configured in a tapered surface located interiorly of said barrel at the fore end thereof, the axis of said tapered surface being oriented in said barrel such that the tip of said tapered surface faces said ram so as to provide initial thermal contact with the feedstock at said tip, said heater block including a base formed integral with said tapered section, said base defining a discharge bore that communicates with the interior of said barrel through at least one port in said heater block adjacent the inside periphery of said barrel, a discharge valve in said discharge bore for controlling the discharge of molten feedstock from said device, and a movable spring loaded abutment adapted continuously to bias said discharge valve closed except when said abutment is removed from abutting engagement with said valve, said abutment being retractable from abutting contact with said valve to allow said valve to open when molten feedstock discharge is desired, and said abutment being allowed to return into abutting engagement with said valve to spring bias said valve closed when molten feedstock discharge is not desired.

2. An improvement as set forth in claim 1 wherein said discharge valve is hydraulically unbalanced, said valve being opened at least partially due to hydraulic pressure of molten feedstock in said discharge bore after said spring loaded abutment has been removed from abutting engagement with said valve.

3. An improvement as set forth in claim 1 including minor spring means to assist opening of said discharge valve after said spring loaded abutment has been removed from abutting engagement with said valve, said minor spring means having a strength less than the spring loaded abutment's major spring means.

4. An improvement as set forth in claim 1 wherein said discharge valve includes a valve stem fixed to a valve head, said valve stem extending outwardly of said base through a valve stem port therein, and wherein said spring loaded abutment is located exteriorly of said base, and including a static bellows type seal fixed to one of said valve stem and said valve head at one end and to said base at the other end so as to prevent leakage of molten feedstock through said valve stem port.

5. An improvement as set forth in claim 4 including minor spring means to assist opening of said discharge valve after said spring loaded abutment has been removed from abutting engagement with said valve, said minor spring means having a strength less than the spring loaded abutment's major spring means, and said minor spring means being provided by placing said bellows seal under slight tension in that attitude where the discharge valve is closed.

6. An improvement as set forth in claim 4 including minor spring means to assist opening of said discharge valve after said spring loaded abutment has been removed from abutting engagement with said valve, said minor spring means having a strength less than the spring loaded abutment's major spring means, and said minor spring means being provided by a compression spring exteriorly of said base that is interconnected with said valve stem.

7. An improvement as set forth in claim 1 including a trigger assembly having a trigger connected to said spring loaded abutment, said spring loaded abutment being retracted from abutting contact with said valve when said trigger is actuated.

8. In a device adapted to translate a feedstock such as a thermoplastic adhesive from a solid state to a molten state, the improvement comprising a heater block disposed at the fore end of a barrel, said heater block including a nose portion that extends interiorly of the barrel in axial alignment therewith, said heater block also defining a discharge bore that communicates with the interior of said barrel, a hydraulically unbalanced discharge valve controlling the discharge of molten feedstock from said device, and a movable spring loaded abutment adapted continuously to bias said discharge valve closed except when said abutment is removed from abutting engagement with said valve, said abutment being retractable from abutting contact with said valve to allow said valve to open due to hydraulic pressure within said discharge bore when molten feedstock discharge is desired, and said abutment being allowed to return into abutting engagement with said valve to spring bias same closed against the hydraulic pressure when molten feedstock discharge is not desired.

9. An improvement as set forth in claim 8 wherein said hydraulically unbalanced discharge valve includes a valve stem fixed to a valve head, said valve stem extending outwardly of said base through a valve stem port therein, and wherein said spring loaded abutment is located exteriorly of said heater block.

10. An improvement as set forth in claim 9 including a static bellows type seal fixed to one of said valve stem and said valve head at one end and to said heater block at the other end so as to prevent leakage of molten feedstock through said valve stem port.

11. An improvement as set forth in claim 9 including a trigger assembly having a trigger connected to said spring loaded abutment, said spring loaded abutment being retracted from abutting contact with said valve when said trigger is actuated.

12. An improvement as set forth in claim 11 wherein said spring loaded abutment and valve stem are adapted to move in coaxial linear paths, and wherein said trigger is connected with said spring loaded abutment by a lost motion slot so that arcuate motion of said trigger does not violate the linear motion of said spring loaded abutment.

13. An improvment as set forth in claim 8 wherein said hydraulically unbalanced discharge valve is provided with a minor spring assist, said minor spring assist adapted to oppose the spring loaded abutment's major spring to aid in opening said discharge valve when said spring loaded abutment is removed from abutting engagement with said valve.

14. An improvement as set forth in claim 13 wherein said hydraulically unbalanced discharge valve includes a valve stem fixed to a valve head, said valve stem extending outwardly of said base through a valve stem port therein and a static bellows type seal fixed to one of said valve stem and said valve head at one end and to said heater block at the other end so as to prevent leakage of molten feedstock through said valve stem port, and wherein said spring loaded abutment is located exteriorly of said heater block, and wherein said minor spring is in the nature of a compression spring located exteriorly of said heater block and interconnected with said valve stem.

15. An improvement as set forth in claim 13 wherein said hydraulically unbalanced discharge valve includes a valve stem fixed to a valve head, said valve stem extending outwardly of said base through a valve stem port therein, and a static bellows type seal fixed to one of said valve stem and said valve heat at one end to said heater block at the other end so as to prevent leakage of molten feedstock through said valve stem port, and wherein said spring loaded abutment is located exteriorly of said heater block, and wherein said minor spring assist is provided by placing said bellows type seal in tension when said discharge valve is closed.

16. In a device adapted to translate a feedstock such as a thermoplastic adhesive from a solid state to a molten state, the improvement comprising a barrel, and a heater block located at the fore end of said barrel, and a cooling means including coolant distribution chamber disposed about the outer periphery of said barrel aft of said heater block and operable to direct a coolant flow of air from said chamber to the atmosphere in an axial direction over the outer peripheral surface of said banel, said coolant means being operable to establish air flow level sufficient to maintain a substantial axial thermal gradient along the length in said barrel so as to maintain a solid-melt interface inside the barrel adjacent to said heater block.

17. An improvement as set forth in claim 16 wherein said cooling chamber is in the nature of an annular chamber, same being provided coolant air from a fluid source.

18. An improvement as set forth in claim 17 wherein the fore wall of said cooling chamber is sized to create an annular gap at said barrel's outer periphery, thereby providing an annular port through which the coolant air can escape around the forward end of said barrel.

19. An improvement as set forth in claim 17 wherein said fluid source is a single inlet air line, and including a ram at least partially located in said barrel and driven by a pneumatic motor, said single inlet air line also serving to power said pneumatic motor for the gun's ram.

20. A thermoplastic material dispensing apparatus adapted to convert solid thermoplastic feedstock material from a solid state to a molten state and subsequently dispense said molten material, said apparatus including a barrel having a charging port, a ram reciprocable relative to said barrel, said ram being adapted to force the feedstock toward the fore end of said barrel, and a heater block generally shaped as a truncated cone located interiorly of said barrel at the fore end thereof, said cone being foreshortened from its vanishing point to create a blunt end tip, the axis of said truncated cone being aligned generally parallel to the axis of said barrel and being oriented in said barrel such that said blunt tip of said truncated cone faces said ram so as to provide initial thermal contact with the feedstock at said tip, said truncated cone being truncated from its vanishing point to an extent sufficient to enable a consistent thermal gradient to be maintained along the axis of said heater block, and to enable the temperature of the truncated blunt end tip to be maintained at least at the melt point of the feedstock without substantially exceeding the melt point temperature of the feedstock at any point on the surface of the truncated cone so that melt rate of the feedstock is maximized without subjecting the feedstock to excessive temperature.

21. A thermoplastic material dispensing apparatus adapted to convert a thermoplastic feedstock material from a solid state to a molten state and subsequently dispense said molten material, said apparatus including, a main frame, a barrel with a charging port supported by said frame, means including a coolant flow distribution chamber surrounding said barrel, first porting means for connecting said coolant flow distribution chamber to a source of cooling fluid, a heater and nozzle mounted at the fore end of said barrel, a ram reciprocable relative to said barrel, said ram being adapted to force the feedstock toward the fore end of said barrel, and said ram having a piston head located within a motor housing, said piston head being reciprocable in said motor housing, second porting means for connecting said source of cooling fluid of said motor housing, and valve means disposed in said motor housing, said valve means being operable to control the flow of motive cooling fluid to and from said motor housing, said motive fluid being operable to positively drive and cool said piston and ram within said motor housing in both fore or aft directions of reciprocation.

22. The apparatus as set forth in claim 21 wherein said main frame comprises a fluid manifold, and passageways formed in said mainfold for simultaneously conducting motive cooling fluid to said motor housing and cooling fluid to the fore end of said barrel.

23. The apparatus set forth in claim 21 wherein said ram has a hardened element secured to its forward end, said hardened element cooperating with said charging port in said barrel to form a shear, said shear being adapted to cut off any excess feedstock material tending to block said charging port during forward movement of said ram.

24. The apparatus set forth in claim 21 wherein said piston head has a cross-sectional area which is at least three times greater than the cross-sectional area of said ram.

25. Thermoplastic feedstock melting means comprising a heating surface disposed within a feedstock transfer barrel, said heating surface configured to simultaneously melt solid advancing feedstock and radially outwardly displace said solid advancing feedstock into intimate contact with the interior surface of said feedstock transfer barrel, and means including an air coolant distribution channel surrounding said barrel for directing coolant fluid from said channel into the atmosphere in an axial direction over the outer peripheral surface of said barrel to cool said barrel and establish a substantial axial thermal gradient with decreasing barrel temperature upstream of said heating surface.

26. A device adapted to translate a feedstock such as a solid thermoplastic adhesive from a solid state to a molten state, comprising a barrel having a charging port, a ram reciprocable relative to said barrel, said ram being adapted to force the feedstock toward the fore end of said barrel, and a heater block at least partially configured in a tapered surface located interiorly of said barrel at the fore end thereof, said tapered surface being oriented in said barrel such that an end tip of said tapered surfaces faces said ram so as to provide initial thermal contact with the feedstock at said tip, said tapered surface of said heater block and the interior surface of said barrel defining therebetween a converging channel through which the feedstock is forced during passage toward said fore end of said barrel, said feedstock having a transition region in which it converts from the solid to the molten state, and the improvement which comprises means for maintaining the said transition region at the point at which it contacts said barrel confined within said converging channel such that said barrel contacting portion of said transition region is subject to a force normal to said interior surface of said barrel and acts as a physical dam to prevent backflow of molten material along the inside surface of said barrel, said transition region confining means including an air flow channel surrounding said barrel aft of said heater block, and means for transmitting air from said air flow channel over the outer surface of said barrel so as to radially carry heat away from said barrel via said air.

27. The device of claim 26 in which said transition region confining means includes means for maintaining a large thermal temperature gradient along the axial extent of said barrel in the region of said heater block.

28. The device of claim 26 in which said tapered surface heater block is generally conical from base to tip, said tapered surface being shortened from its apex to define a blunt tip the surface area of which is determined by the combination of surface heat flux and thermal conductivity of said heater block so that the tip temperature of said heater block is maintained at or above the feedstock softening point and the temperature of said tapered surface has a minimum thermal gradient.

29. A device adapted to translate a feedstock such as a solid thermoplastic adhesive from a solid state to a molten state, comprising a barrel having a charging port, a ram reciprocable relative to said barrel, said ram being adapted to force the feedstock toward the fore end of said barrel, and a heater block at least partially configured in a tapered surface located interiorly of said barrel at the fore end thereof, said tapered surface being oriented in said barrel such that an end tip of said tapered surface faces said ram so as to provide initial thermal contact with the feedstock at said tip, said tapered surface of said heater block and the interior surface of said barrel defining therebetween a converging channel through which the feedstock is forced during passage toward said fore end of said barrel, said feedstock having a transition region in which it converts from the solid to the molten state, and the improvement which comprises means for maintaining the said transition region at the point at which it contacts said barrel confined within said converging channel such that said barrel contacting portion of said transition region is subject to a force normal to said interior surface of said barrel and acts as a physical dam to prevent backflow of molten material along the inside surface of said barrel.

30. The device of claim 29 in which said transition region confining means includes an air coolant distribution chamber surrounding said barrel for receiving coolant fluid and directing it into the atmosphere.

* * * * *

UNITED STATES PATENT AND TRADEMARK OFFICE

CERTIFICATE OF CORRECTION

PATENT NO. : 4,026,440

DATED : May 31, 1977

INVENTOR(S) : Gerald W. Crum; Eric T. Nord; Alan B. Reighard
Simon Z. Tamny

It is certified that error appears in the above-identified patent and that said Letters Patent are hereby corrected as shown below:

Col. 10, line 66, "hearing" should be -- bearing --

Col. 12, line 22, "of" should be -- on --

Col. 12, line 56 - "not" should be -- note --

Col. 13, line 31, "stroling" should be -- stroking --

Col. 14, line 45, "tire" should be -- tie --

Col. 24, Claim 15, line 10 - "heat" should be -- head --

Col. 24, Claim 16, line 28 "banel" should be -- barrel --

Signed and Sealed this

*Twenty-second* Day of *November 1977*

[SEAL]

*Attest:*

RUTH C. MASON
*Attesting Officer*

LUTRELLE F. PARKER
*Acting Commissioner of Patents and Trademarks*